US008185388B2

(12) United States Patent
Gao

(10) Patent No.: US 8,185,388 B2
(45) Date of Patent: May 22, 2012

(54) APPARATUS FOR IMPROVING PACKET LOSS, FRAME ERASURE, OR JITTER CONCEALMENT

(75) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 973 days.

(21) Appl. No.: 12/177,370

(22) Filed: Jul. 22, 2008

(65) Prior Publication Data

US 2009/0037168 A1 Feb. 5, 2009

Related U.S. Application Data

(60) Provisional application No. 60/962,471, filed on Jul. 30, 2007.

(51) Int. Cl.
*G10L 19/00* (2006.01)
*G10L 21/02* (2006.01)

(52) U.S. Cl. ..... 704/228; 704/500; 714/746

(58) Field of Classification Search ..... 704/228
See application file for complete search history.

(56) References Cited

U.S. PATENT DOCUMENTS

| | | | | |
|---|---|---|---|---|
| 7,831,421 | B2 * | 11/2010 | Khalil et al. | 704/228 |
| 7,930,176 | B2 * | 4/2011 | Chen | 704/228 |
| 2011/0125505 | A1 * | 5/2011 | Vaillancourt et al. | 704/500 |

* cited by examiner

*Primary Examiner* — James S. Wozniak
*Assistant Examiner* — Neeraj Sharma
(74) *Attorney, Agent, or Firm* — Huawei Technologies Co., Ltd.

(57) ABSTRACT

The invention presents a method to improve the recovering from packet loss, frame erasure or jitter concealment during signal communication, especially for VoIP (Voice Over Internet Protocol) applications. A variable delay concept (instead of constant delay) is introduced to guarantee the continuity and periodicity of signal after recovering lost frames, adding frames or removing frames. During the recovering of lost frames or the adding of extra frames, the copy of previous signal from history buffer into missing frame(s) is based on the frame length, onset, and offset information.

5 Claims, 3 Drawing Sheets

Example for Improving Packet Loss Concealment With Pitch Lag Increasing from Short to Long

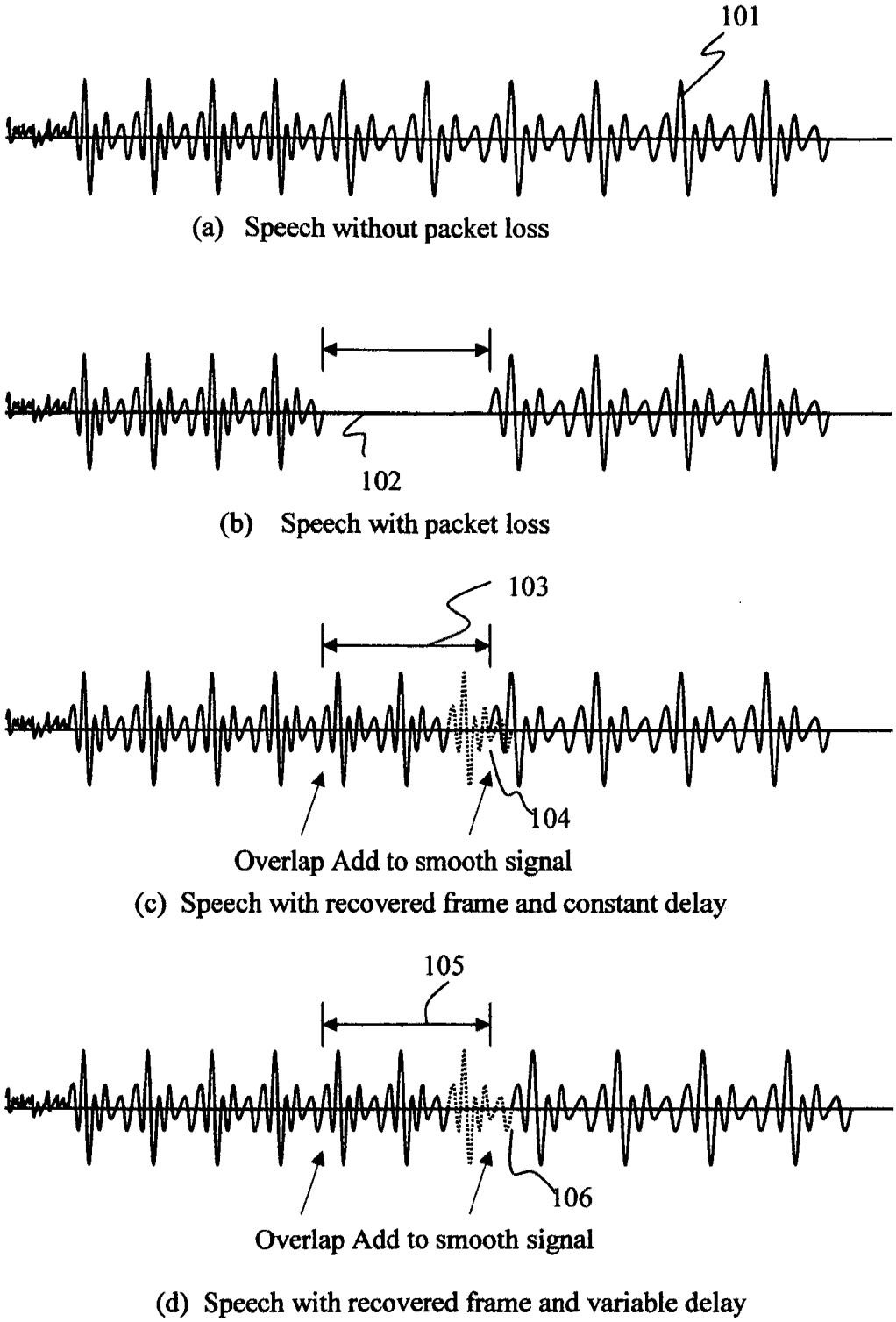
FIG. 1 Example for Improving Packet Loss Concealment With Pitch Lag Increasing from Short to Long

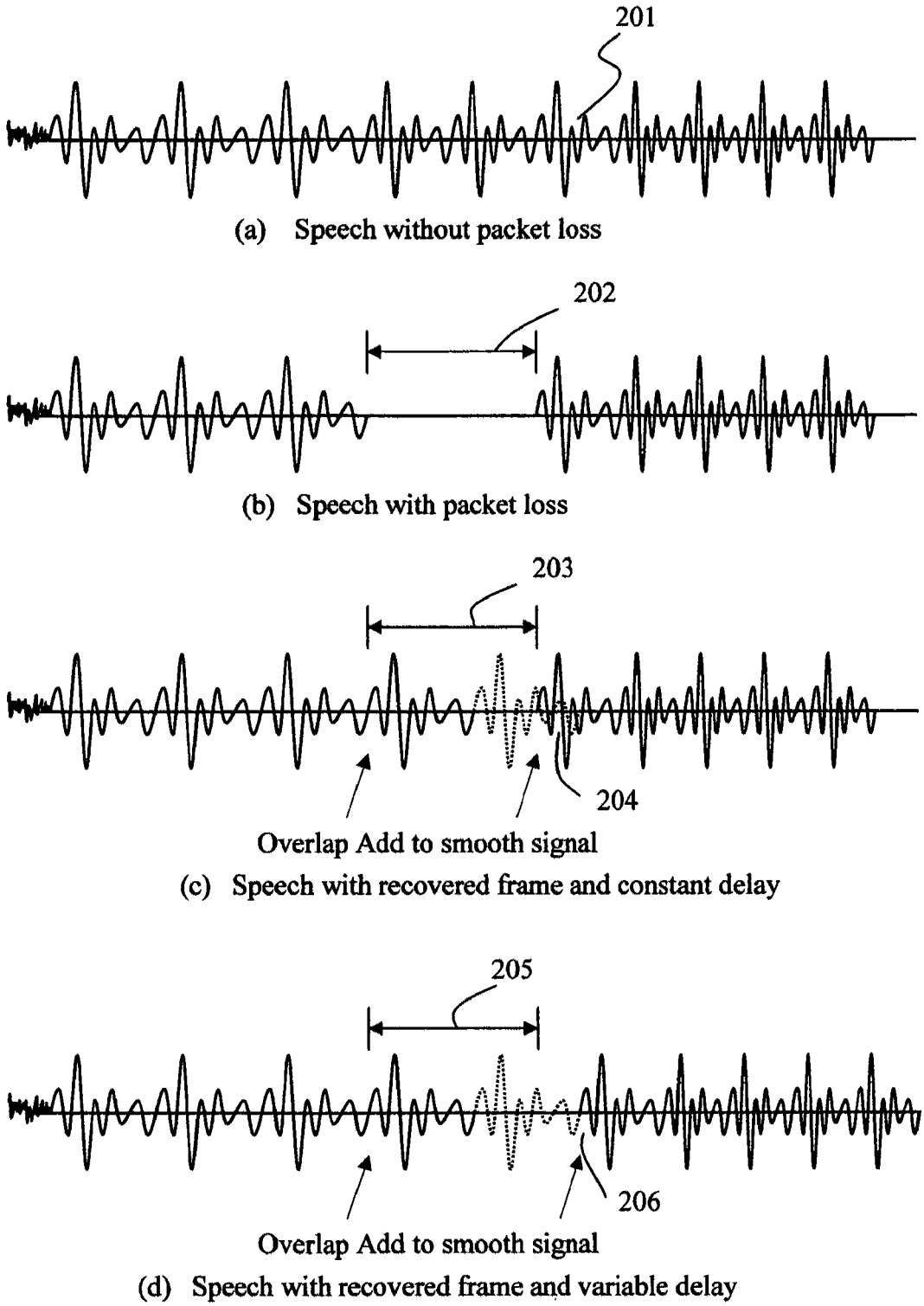
FIG. 2 Example for Improving Packet Loss Concealment With Pitch Lag Decreasing from Long to Short

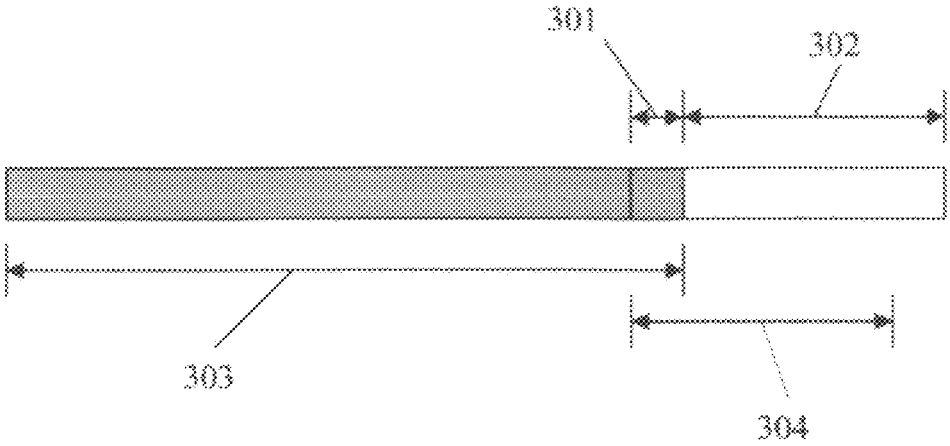
(a) Pre-art with constant delay
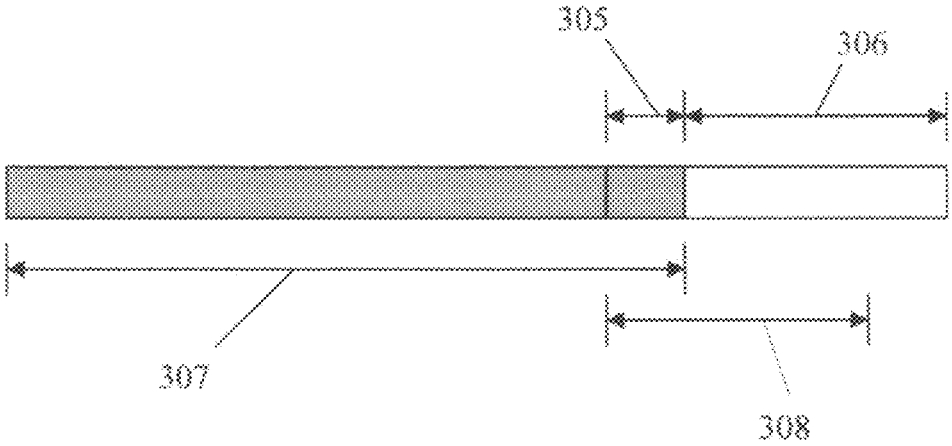
(b) Improved with variable delay
FIG. 3 Comparison of Speech Buffer Handling

APPARATUS FOR IMPROVING PACKET LOSS, FRAME ERASURE, OR JITTER CONCEALMENT

CROSS REFERENCE TO RELATED APPLICATIONS

US Issued U.S. Pat. No. 7,233,897

BACKGROUND OF THE INVENTION

1. Field of the Invention

The present invention is generally in the field of signal coding. In particular, the present invention is in the field of speech coding and specifically in application where packet loss and/or jitter concealment is an important issue during (voice) signal packet transmission.

2. Background Art

The typical pre-art is described in the patent (U.S. Pat. No. 7,233,897), titled "Method and apparatus for performing packet loss or frame erasure concealment". The invention concerns a method and apparatus for performing Packet Loss or Frame Erasure Concealment (PLC or FEC) for a speech coder that, in particular, does not have a built-in or standard FEC processing module, such as the initial ITU G.711 speech coder. The invention described in the patent of U.S. Pat. No. 7,233,897 was used in the ITU G.711 decoder named as ITU G.711 Appendix I.

Packet Loss or Frame Erasure Concealment (PLC or FEC) techniques hide transmission losses in an audio system where the input signal is encoded and packetized at a transmitter, sent over a network, and received at a receiver that decodes the frame and plays out the output. A receiver with a decoder receives encoded frames of compressed speech information transmitted from an encoder. A lost frame detector at the receiver determines if an encoded frame has been lost or corrupted in transmission, or erased. If the encoded frame is not erased, the encoded frame is decoded by a decoder and a temporary memory is updated with the decoder's output. A predetermined constant delay period is applied and the audio frame is then played out. The constant delay is used to apply Overlap Adds (OLA) to smooth the frame boundary between the recovered frame and the received frame, as explained later. If the lost frame detector determines that the encoded frame is erased, a FEC module applies a frame concealment process to the signal. FIG. 1 and FIG. 2 have shown two examples where one frame is missing and recovered by a FEC module.

This FEC process employs a replication of pitch waveforms to synthesize missing speech; the process replicates a number of pitch waveforms, in which the number of the repeated pitch cycles increases with the length of the erasure. In other words, the number of pitch periods used from the history buffer is increased as the length of the erasure progresses. Short erasures only use the last or last few pitch periods from the history buffer to generate the synthetic signal. Long erasures also use pitch periods from further back in the history buffer. With long erasures, the pitch periods from the history buffer are not necessary to be replayed in the same order in that they occurred in the original speech.

For example, the frame size is 20 ms; one pitch cycle from the history buffer is copied and repeated in the first missing frame; two pitch cycles from the history buffer are copied and repeated in the second missing frame; three pitch cycles from the history buffer are copied and repeated in the third missing frame; four pitch cycles from the history buffer are copied and repeated in the fourth missing frame.

In addition, to insure a smooth transition between erased and non-erased frames, a delay module also delays the output of the system by a predetermined constant time interval; for example, 3.75 msec delay was used in the standard of ITU G711 Appendix I. This delay allows the synthetic erasure signal to be slowly mixed in with the real output signal at the beginning and/or the end of an erasure. Whenever a transition is made between signals from different sources, it is important that the transition does not introduce discontinuities audible as clicks, or unnatural artifacts into the output signal. These transitions occur in several places: 1) At the start of the erasure at the boundary between the start of the synthetic signal and the tail of last good frame. 2) At the end of the erasure at the boundary around the end point of the synthetic signal and the starting point of the signal in the first good frame after the erasure. 3) Whenever the number of pitch periods used from the history buffer is changed to increase the signal variation. 4) At the boundaries between the repeated portions of the history buffer.

To insure smooth transitions, traditionally Overlap Adds (OLA) are performed at all signal boundaries. OLA are a way of smoothly combining two signals that overlap at one edge. The constant delay of (3.75 msec) makes the OLA possible. In the region where the signals overlap, the signals are weighted by windows and then added (mixed) together. The windows are designed so the sum of the weights at any particular sample is equal to 1. That is, no gain or attenuation is applied to the overall sum of the signals. In addition, the windows are designed so that the signal on the left starts out at weight 1 and gradually fades out to 0, while the signal on the right starts out at weight 0 and gradually fades in to weight 1. Thus, in the region to the left of the overlap window, only the left signal is present while in the region to the right of the overlap window, only the right signal is present. In the overlap region, the signal gradually makes a transition from the signal on left to that on the right. In the FEC process, triangular windows are often used to keep the complexity of calculating the windows low, but other windows, such as Hanning windows, can be used instead. FIG. 1 and FIG. 2 have shown some of the locations where the OLA may be needed.

While the adding of the delay of allowing the OLA may be considered as an undesirable aspect of the process, it is necessary to insure a smooth transition between real and synthetic signals. For some applications, adding a small delay may not be a big issue since the overall communication trip delay could be more than 150 msec.

While many of the standard Code-Excited Linear Prediction (CELP)-based speech coders, such as ITU-T's G.723.1, G.728, and G.729 have FEC algorithms built-in or proposed in their standards. Those kind of coders might not be able to benefit from the above invention described in U.S. Pat. No. 7,233,897.

SUMMARY OF THE INVENTION

The invention presents a method to improve the recovering from packet loss, frame erasure or jitter concealment during signal communication, especially for VoIP (Voice Over Internet Protocol) applications. A variable delay concept (instead of constant delay) is introduced to guarantee the continuity and periodicity of speech signal after recovering the last lost voice frame. The variable delay concept could also allow to add frames or remove frames in a smoothing way for jitter concealment applications. During the recovering of lost voice frames or the addition of extra speech frames, the copy of previous signal from history buffer into missing frame is based on the frame length, onset, and offset information.

BRIEF DESCRIPTION OF THE DRAWINGS

The features and advantages of the present invention will become more readily apparent to those ordinarily skilled in the art after reviewing the following detailed description and accompanying drawings, wherein:

FIG. 1 shows an example of improving packet loss concealment by using variable delay approach, in which the pitch lag increases from short to long.

FIG. 2 shows another example of improving packet loss concealment by using variable delay approach, in which the pitch lag decreases from long to short.

FIG. 3 further compares the constant delay with the variable delay.

DETAILED DESCRIPTION OF THE INVENTION

The present invention discloses a method to improve the recovering from packet loss, frame erasure or jitter concealment during signal communication, especially for VoIP (Voice Over Internet Protocol) applications. A variable delay concept (instead of constant delay) is introduced to guarantee the continuity and periodicity of signal after recovering last lost frame. The variable delay concept could also allow to add frames or remove frames in a smoothing way for jitter concealment applications. During the recovering of lost frames or the addition of extra frames, the copy of previous signal from history buffer into missing frame is based on the frame length, onset, and offset information.

The following description contains specific information pertaining to the Packet Loss Concealment algorithm which could be a part of a speech decoder or work as an independent module. However, one skilled in the art will recognize that the present invention may be practiced in conjunction with various encoding/decoding algorithms or jitter buffer control algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

1. Introducing Variable Delay to Maximize the Correlation Between Recovered Synthetic Signal and Real Signal FIG. 1 shows an example of improving packet loss concealment by using variable delay approach, in which the pitch lag increases from short to long. In FIG. 1(*a*), 101 is a decoded speech signal output without packet loss. FIG. 1(*b*) gives the same speech signal; but speech frame(s) or speech packet(s) are lost at the location 102. FIG. 1(*c*) describes that the lost frame(s) are recovered by repeating the previous pitch cycles as shown at 103. Due to the fact that the pitch periods at 103 copied from the history buffer into missing frame(s) usually do not have exactly the same pitch values as real speech at the location of missing frame(s), the first received pitch cycle of real speech starting at 104 following the last missing frame 103 could not be aligned with the recovered synthetic signal at the area 104 (see FIG. 1(*c*)). Although the OLA can smooth the signals at 104 and avoid the discontinuities, the OLA can not solve the periodicity problem due to the misalignment at 104. The misalignment causes obviously audible distortion. FIG. 1 (*d*) shows the same signal but with a variable delay to compensate for the misalignment. The efficient solution is to shift the received real speech signal starting at 106 after the last missing frame 105 so that the correlation between the first real received pitch cycle and the last synthetic pitch cycle could be maximized at 106 (see FIG. 1(*d*)). By common sense in the field, the normalized correlation between any two segments of signals $s_1(n)$ and $s_2(n)$ are mathematically defined as $$R(\tau) = \frac{\sum_n s_1(n) \cdot s_2(n+\tau)}{\sqrt{\left(\sum_n s_1(n) \cdot s_1(n)\right) \cdot \left(\sum_n s_2(n+\tau) \cdot s_2(n+\tau)\right)}}, \quad (1)$$

In (1), $\tau$ controls the signal shifting. It is obvious that at the location around 104 in FIG. 1(*c*), the distance between the two pitch peaks is too short; after the alignment process, the distance between the two pitch peaks around the location 106 in FIG. 1(*d*) becomes normal.

Although the additional variable delay is introduced by shifting the following received speech signal, it is worth it for most applications where the perceptual quality is most important. The maximum variable delay could be limited to a value.

FIG. 2 shows another example of improving packet loss concealment by using variable delay approach, in which the difference from FIG. 1 is that pitch lag decreases from long to short. In FIG. 2(*a*), 201 is a decoded speech signal output without packet loss. FIG. 2(*b*) gives the same speech signal; but speech frame(s) or speech packet(s) are lost at the location 202. FIG. 2(*c*) describes that the lost frame(s) are recovered by repeating the previous pitch cycles as shown at 203. Due to the fact that the pitch periods 203 copied from the history buffer into missing frames usually do not have exactly the same pitch values as real speech in missing frames, the first received pitch cycle of real speech starting at 204 following the last missing frame 203 could not be aligned with the recovered synthetic signal at the area 204 (see FIG. 2(*c*)). Although the OLA can smooth the signals at 204 and avoid the discontinuities, the OLA can not solve the periodicity problem due to the misalignment at 204. The misalignment causes obviously audible distortion. FIG. 2(*d*) shows the same signal but with a variable delay to compensate for the misalignment. The efficient solution is to shift the received real speech signal starting at 206 after the last missing frame 205 so that the pitch correlation between the first real received pitch cycle and the last synthetic pitch cycle could be maximized at 206 (see FIG. 2(*d*)).

FIG. 3 also compares the constant delay to the variable delay in simple time domain. 301 is a constant delay. 302 is a new received frame. 303 shows speech signal buffer. 304 is the output frame played out to speaker. If the previous frame was lost during transmission, it should be recovered by an FEC or PLC algorithm; then the OLA should happen at the end of 301 and the beginning of 302. In FIG. 3(*b*), 306 is the new arrived frame; 307 is the speech signal buffer. Assuming that the last frame was lost and recovered by the FEC or PLC algorithm, 305 is the proposed variable delay which is determined by shifting the new arrived frame and maximizing the pitch correlation between the new arrived frame and the last recovered signal; the OLA should happen at the end of 305 and the beginning of 306. 308 is the output frame played out to speaker.

2. Always Copy about One Frame of Speech from the History Buffer into Missing Frames to Balance Continuity, Smoothness, Periodicity, and Naturalness The pitch estimate could be wrong. The estimated pitch could be multiple of the real pitch. When only one pitch period from the history buffer is copied and repeated, there exists the risk of over-periodicity or too many OLA transitions introduced. When several pitch periods are copied together from the history buffer, less OLA transitions are needed; but the copied signal could come from an area which is too far back in the history buffer before the current missing frame so that the spectrum variation could be too big, due to wrong estimation of pitch lag. Maybe there is no perfect solution regarding how to recover the missing frames; however, coping the history buffer signal into missing frames based on the frame size could give a good balance between continuity, smoothness, periodicity, and naturalness, regardless of correct pitch estimation or wrong pitch estimation. This means that the best pitch correlation is always searched at the distance around the frame size, which is often defined as 20 ms. The obtained "pitch estimate" by maximizing the correlation at a distance around the frame size could be real pitch or multiple of real pitch; because it is always around the frame size, FEC or PLC algorithm always copy about one frame of signal from the history buffer into missing frames and repeat a little bit if necessary, except of onset or offset areas where the previous signal at the distance of one pitch cycle should be copied. If the distance at that the past signal is copied into the missing frame is defined as copying distance, the copying distance should be around the frame size and also equal to or close to one pitch lag or multiple pitch lags.

3. Insert or Remove Frames by Using Variable Delay Concept for VoIP Applications For Voice Over Internet Protocol (VoIP) applications, sometimes it is necessary to insert or remove frames at receiver side due to bad network conditions or different timings of two end user equipments. Such a process is also called jitter buffer control, where the jitter means the undesired timing difference between the transmitter and receiver. One frame size normally is not just equal to pitch lag or multiple of pitch lags so that the periodicity of speech signal could be destroyed after simply removing or adding exactly the same constant frame size; although OLA can help a little bit at the frame boundaries, it can not keep the needed periodicity. In order to keep continuity and periodicity after inserting frames or removing frames, the variable delay concept can be also employed to achieve the goal by maximizing the pitch correlation. In fact, a variable delay is introduced during removing or adding frames in order to maintain the signal periodicity and continuity. The best variable delay is determined by maximizing the correlation between the added signal and the following signal, when a frame is added; when a frame is removed, the best variable delay is determined by maximizing the correlation between the last signal and the following signal; the alignment between the previous signal and the following signal is achieved by shifting the following signal at a limited range, resulting a variable signal delay.

What is claimed is:

1. A method of significantly improving Packet Loss Concealment (PLC) or Frame Erasure Concealment (FEC) algorithm performance and maintaining signal periodicity in a decoder, the method comprising:

Receiving a current signal following a previously recovered signal;

Introducing a limited variable delay to the received current signal; and

Determining the limited variable delay by maximizing the correlation between the received current signal and the recovered signal, using the formula:

$$R(\tau) = \text{Norm_Factor} \cdot \sum_n s_1(n) \cdot s_2(n+\tau)$$

wherein $s_1(n)$ is the recovered signal extended from a previous frame into a current frame, $s_2(n)$ is the received current signal in the current frame, $\tau$ is the variable delay which controls shifting of the received current signal, Norm_Factor is a normalization factor, and $R(\tau)$ is the correlation between the received current signal and the recovered signal.

2. The method of claim 1, wherein Norm_Factor is defined as, $$\text{Norm_Factor} = \frac{1}{\sqrt{\left(\sum_n s_1(n) \cdot s_1(n)\right) \cdot \left(\sum_n s_2(n+\tau) \cdot s_2(n+\tau)\right)}}.$$

3. The method of claim 1, wherein the recovered signal is obtained by using PLC or FEC algorithm which comprises a copy of previous signals from a history buffer into missing frame(s) and an Overlap Adds (OLA) of the copied signals.

4. The method of claim 1, wherein the received current signal is obtained by decoding a normally or correctly received frame when the frame is not lost during a transmission.

5. The method of claim 1 further comprising the steps of:

Aligning the received current signal with the recovered signal;

And determining the variable delay while avoiding a too short or too long distance between two pitch peaks around the boundary of the recovered signal and the received current signal.

* * * * *